United States Patent [19]

Stephen et al.

[11] Patent Number: 4,933,266

[45] Date of Patent: Jun. 12, 1990

[54] PHOTOGRAPHIC BLEACHING AND BLEACH-FIXING SOLUTIONS

[75] Inventors: Keith H. Stephen; Carol J. MacDonald, both of Rochester, N.Y.

[73] Assignee: Eastman Kodak Company, Rochester, N.Y.

[21] Appl. No.: 162,549

[22] Filed: Mar. 1, 1988

[51] Int. Cl.[5] ..... G03C 7/42

[52] U.S. Cl. ..... 430/393; 430/430; 430/460; 430/461

[58] Field of Search ..... 430/430, 460, 461, 393

[56] References Cited

U.S. PATENT DOCUMENTS

| | | | |
|---|---|---|---|
| 4,294,914 | 3/1979 | Fyson | 430/418 |
| 4,552,834 | 11/1985 | Lau et al. | 430/461 |
| 4,563,405 | 7/1986 | Ishikawa | 430/460 |
| 4,601,975 | 7/1986 | Koboshi et al. | 430/430 |
| 4,717,647 | 1/1988 | Abe et al. | 430/430 X |

OTHER PUBLICATIONS

*Research Disclosure,* vol. 240, Item 24023, Apr. 1984, p. 156.

*Primary Examiner*—Paul R. Michl
*Assistant Examiner*—Hoa Van Le
*Attorney, Agent, or Firm*—William J. Davis

[57] ABSTRACT

Bleaching and bleach-fixing solutions, especially useful in the processing of a photographic color material, contain a bleaching agent comprising a ferric complex of propylenediaminetetraacetic acid and a hydroxy-substituted chelating agent present in an amount sufficient to reduce the formation of ferric propylenediaminetetraacetic acid precipitates. The solutions do not generate unacceptable stain or adversely affect leuco cyan dye recovery or process cleanliness.

6 Claims, No Drawings

PHOTOGRAPHIC BLEACHING AND BLEACH-FIXING SOLUTIONS

FIELD OF THE INVENTION

This invention relates to photographic bleaching and bleach-fixing solutions and to methods of photographic processing utilizing such solutions.

BACKGROUND OF THE INVENTION

In the production of color photographic images, it is usually necessary to remove the silver image which is formed coincident with the dye image. This can be done by oxidizing the silver by means of a suitable oxidizing agent, commonly referred to as a bleaching agent, in the presence of a halide ion, followed by dissolving the silver halide so formed in a silver halide solvent, commonly referred to as a fixing agent. Alternatively, the bleaching agent and fixing agent can be combined in a bleach fixing solution and the silver removed in one step by use of such solution.

In the reversal processing of black and white photographic materials, a bleaching step is also utilized to remove photographically developed silver.

A wide variety of bleaching agents are known for use in photographic processing. A particularly important class of bleaching agents are the aminopolycarboxylic acid bleaching agents. Such bleaching agents are described by K. H. Stephen and C. M. McDonald in *Research Disclosure*, Item 24023, April, 1984, and include the ferric complexes of ethylenediaminetetraacetic acid (EDTA) and propylenediaminetetraacetic (PDTA).

A particularly valuable bleach solution comprises the ferric complex of EDTA as the bleaching agent. However, due to advancements in emulsion technology and recent attempts to shorten photoprocessing times, there is a need to develop more powerful bleach solutions, that is, solutions that are more effective than EDTA bleaches at removing silver from photographic material. While a more powerful bleaching agent is desired, an improved bleach solution should not generate unacceptable stain or adversely affect process cleanliness or leuco cyan dye recovery.

Numerous bleaches have been developed and tested but have generally been found to be unsatisfactory for one or more of these reasons. One approach uses PDTA as a replacement for all or part of the EDTA. The improved effectiveness at removing silver from emulsions of PDTA bleaches compared to EDTA bleaches is known. The *Research Disclosure* noted above describes a bleaching solution including a mixture of the ferric complexes of EDTA and PDTA. However, the use of ferric complexes of PDTA heretofore had not been fully satisfactory, primarily because of the formation of ferric PDTA precipitates in processing solutions.

Thus, what has been desired is a bleaching solution which is better at removing silver from photographic materials than ferric EDTA bleaches and does not generate unacceptable stain or adversely affect leuco cyan dye recovery or process cleanliness.

SUMMARY OF THE INVENTION

We have found that ferric PDTA bleaches tend to form undesirable ferric PDTA precipitates when employed in photographic processing. Such precipitates remove one of the active ingredients from the bleach or bleach fix and, moreover, are an undesirable source of dirt in processing solutions. Specific examples of such precipitates are those formed from reaction of the ferric PDTA with phosphate or arsenate ions. Phosphate ions can arise from contamination of the starting materials, from extraction of the film coatings and from water softening chemicals such as sodium hexametaphosphate. Arsenate ions can also be present as a result of extraction or because of impurities. We have further found that hydroxy-substituted chelating agents are highly effective in reducing the formation of such ferric PDTA precipitates without generating unacceptable stain or adversely affecting leuco cyan dye recovery or process cleanliness.

In accordance with the present invention there is provided a photographic bleaching or bleach-fixing solution containing a bleaching agent comprising a ferric complex of propylenediaminetetraacetic acid and an hydroxy substituted chelating agent present in an amount sufficient to reduce the formation of precipitates formed by reaction of such complex with phosphate or arsenate ions.

The bleaching solution of this invention is better at removing silver from photographic materials than ferric EDTA bleaches and, advantageously, does not generate unacceptable stain or adversely affect leuco cyan dye recovery or process cleanliness.

In accordance with another embodiment of the present invention, there is provided a method of bleaching or bleach-fixing a photographic color material which comprises contacting such material with the above-described solution.

DESCRIPTION OF THE PREFERRED EMBODIMENTS

Preferred chelating agents effective at reducing the formation of ferric PDTA precipitates contain a hydroxy group and include diaminopropanoltetraacetic acid (DPTA), citric acid, and hydroxyethyliminodiacetic acid. Other hydroxy-substituted chelating agents expected to be effective include hydroxyethylethylenediaminetriacetic acid, malic acid, and tartaric acid.

The hydroxy-substituted chelating agent is present in an amount sufficient to reduce the formation of ferric PDTA precipitates. Effective amounts depend of course upon the bleach solution and chelating agent selected and can vary widely. However, effective amounts can be readily determined by one of ordinary skill in the art. These chelating agents may be used either as a single species or as a combination of two or more species. The amount to be used can be preferably 0.0001–0.02 mole, more preferably 0.001–0.01 mole, per liter of solution. Generally, greater amounts of the chelating agent protect against higher levels of ferric PDTA phosphate/arsenate precipitates for longer periods of time.

Although Applicants do not wish to be bound by any theory, it is believed that the hydroxy-substituted chelating agent interferes with the coordination of the phosphate or arsenate precipitate and/or acts as a threshold precipitation inhibitor by reducing crystal growth or interfering with the phosphate or arsenate bridging (which has been observed in inorganic gels) from iron center to iron center.

In addition to the ferric complex of PDTA, the bleach solutions of this invention may also contain other bleaching agents, for example, persulfates and ferric complexes of EDTA. The amount of the bleaching agent(s) used can be 0.05–1.00 mole, preferably 0.05–0.40 mole, per liter of solution. The working strength bleach solutions may have a pH in the range of 4 to 8 and will preferably contain a water-soluble halide, e.g., for color films, potassium bromide or ammonium bromide in a concentration of more than 40 g/liter, preferably from more than 60 g/liter up to the limit of solubility. In one preferred embodiment of this invention, the bleach solution includes a combination of a ferric complex of PDTA and a ferric complex of EDTA as bleaching agents.

The present bleach solutions are more effective than bleach solutions containing ferric EDTA alone due to the higher oxidation potential of the ferric PDTA complex. Consequently, either faster bleaching can be obtained from an equivalent amount of the PDTA bleaching agent or equivalent bleaching can be obtained from a solution containing less halide or PDTA bleaching agent.

The above-described bleach solutions may contain a silver halide solvent, preferably an ammonium or alkali metal thiosulfate, in which case they become bleach-fix solutions. Other silver halide solvents which may be used include, for example, thiocyanates, thioureas and thioethers. These fixing agents can be used in amounts of 5 g/liter up to the limit of solubility.

Any photographic silver halide emulsions may be used in the materials to be processed with the present bleach or bleach fix solutions in the method of this invention. These emulsions may comprise silver chloride, silver bromide, silver bromoiodide, silver chlorobromide or mixtures thereof. Tabular grain, coarse grain or fine grain emulsions prepared by any of the well-known procedures may be used. The emulsions may contain any of the known chemical sensitizers, antifoggants, stabilizers, coating aids and other addenda used in photographic materials. The silver halide emulsions may contain a hydrophilic colloid, for example, gelatin, gelatin derivatives, cellulose derivatives polysaccharides such as dextrose or gum arabic, or synthetic polymeric substances, for example, the water soluble polyvinyl compounds, poly(vinylpyrrolidone) and acrylamide polymers.

The invention is further illustrated by the following examples.

EXAMPLE 1

A 0.27 M PDTA bleach (pH adjusted to 4.50 with $NH_4OH$) was prepared containing 0.27 moles/liter iron (added in the form of $Fe(NO_3)_3 \cdot 9H_2O$), 150 g/liter $NH_4Br$, 41.5 g/liter $KNO_3$ and about 10–15 ml/liter acetic acid. The phosphate induced precipitation profile of the bleach was determined by the addition of various amounts of phosphate added in the form of $NaH_2PO_4 \cdot H_2O$ to the bleach. The results are set forth in Table I.

TABLE I

| Concentration $NaH_2PO_4.H_2O$ (g/liter) | Result |
|---|---|
| <0.01 | no change |
| >0.01 and <0.05 | light and fluffy precipitate first occurs |
| >0.5 | gelatinous |
| >>0.5 | thick gelatinous mass |

Bleaches prepared from other ligands did not exhibit precipitate formation in the presence of phosphate, as indicated in Table II below.

TABLE II

Effect of Adding 1.0 g/liter $NaH_2PO_4.H_2O$ to Several Bleaches

| Bleach Ligand | Bleach pH | Ligand Concentration | Iron Concentration | Result |
|---|---|---|---|---|
| EDTA | 4.75 | 0.30 M | 0.27 M | no change |
| MIDA | 4.75 | 0.81 M | 0.27 M | no change |
| IDA | 4.95 | 0.81 M | 0.27 M | no change |
| PDTA | 4.75 | 0.30 M | 0.27 M | gelatinous mass |

Other chemical species were added to PDTA bleach samples (pH=4.75) in an attempt to induce precipitation. Arsenate was determined to behave like phosphate, but other compounds tested did not induce precipitation. The results are summarized in Table III below.

Contamination of PDTA Bleach by Various Species

| Compound Added | Amount Added (g/liter) | Results |
|---|---|---|
| $H_2SO_4$ | 10 | cs = clear solutions |
| $H_2SO_4$ | 50 | cs |
| $Na_2CO_3$ | 1 | cs |
| $H_3BO_3$ | 1 | cs |
| $Na_2CrO_4$ | 1 | cs |
| $As_2O_5$ | 1 | thick precipitate |
| $As_2O_5$ | 0.5 | thick precipitate |
| $As_2O_5$ | 0.2 | cs |
| $MgCl_2.6H_2O$ | 1 | cs |
| $BaCl_2.2H_2O$ | 1 | cs |
| $LiCl_2$ | 1 | cs |
| $ZnCl_2$ | 1 | cs |

200 mg/liter phosphate (in the form of $NaH_2PO_2$) was added to a 0.27M PDTA bleach (pH=4.75) prepared as described above and was used as the bleach in the C-41 process. In the absence of a chelating agent, an unacceptable yellow precipitate formed within 24 hours.

When DPTA was added to the bleach in an amount of 1 g/liter (0.0031 moles/liter) no unacceptable precipitate was observed even after 3 weeks. DPTA in an amount of 2 g/liter had no deleterious effects on bleaching or leuco cyan dye recovery.

EXAMPLES 2–3

Example 1 was repeated except that the DPTA was replaced with citric acid and hydroxethyliminodiacetic acid, which are hydroxy substituted chelating agents useful in the practice of this invention, respectively in Examples 2 and 3. Each of these chelating agents was effective in reducing the formation of unacceptable precipitate, however, greater amounts (compared to DPTA) were required for equivalent protection.

COMPARATIVE EXAMPLE

Example 1 was repeated except that the DPTA was replaced with 4.5 g/liter (0.011 moles/liter) of the pentasodium salt of nitrilotrimethylene phosphonic acid, a chelating agent not having hydroxy substitution and thus outside of this invention. This amount reduced the formation of the yellow gel for two weeks. However, this amount had deleterious effects on the silver bleaching rate and the recovery op leuco cyan dye. In addition, nitrilotrimethylene phosphonic acid hydrolyzes to yield phosphate ion, the species being protected against.

The invention has been described in detail with particular reference to preferred embodiments thereof, but it will be understood that variations and modifications can be effected within the spirit and scope of the invention.

What is claimed is:

1. In a photographic bleaching or bleach-fixing solution containing a bleaching agent present in an amount of 0.05–1.00 mole per liter of solution comprising a ferric complex of propylenediaminetetraacetic acid, the improvement wherein said solution further comprises an hydroxy-substituted chelating agent present in an amount of 0.0001–0.02 mole per liter of solution and sufficient to reduce the formation of precipitates formed by reaction of said complex with phosphate or arsenate ions.

2. The solution of claim 1 wherein said chelating agent is selected from the group consisting of diaminopropanoltetraacetic acid, citric acid, and hydroxyethyliminodiacetic acid.

3. The solution of claim 1 wherein said chelating agent is diaminopropanoltetraacetic acid.

4. The solution of claim 1 wherein said bleaching agent is an ammonium or alkali metal salt of said ferric complex.

5. The solution of claim 1 comprising a second bleaching agent comprising a ferric complex of ethylenediaminetetraacetic acid.

6. A method of bleaching or bleach-fixing a photographic color material which comprises contacting said material with a bleaching solution containing a bleaching agent present in an amount of 0.05–1.00 per liter of solution comprising a ferric complex of propylenediaminetetraacetic acid, and an hydroxy-substituted chelating agent present in an amount of 0.0001–0.02 mole per liter of solution and sufficient to reduce the formation of precipitates formed by reaction of said complex with phosphate or arsenate ions.

* * * * *